United States Patent [19]

Herron

[11] Patent Number: 4,511,289

[45] Date of Patent: Apr. 16, 1985

[54] METHOD OF ROCK BOLTING AND ROCK BOLT

[75] Inventor: Lorne R. Herron, Beaconsfield, Canada

[73] Assignee: Atlas Copco Aktiebolag, Nacka, Sweden

[21] Appl. No.: 434,177

[22] Filed: Oct. 14, 1982

[30] Foreign Application Priority Data

Oct. 19, 1981 [SE] Sweden ..... 8106165

[51] Int. Cl.[3] ..... E21D 20/00

[52] U.S. Cl. ..... 405/259; 411/19; 405/288

[58] Field of Search ..... 405/259, 260, 261, 288; 411/20, 19, 15

[56] References Cited

U.S. PATENT DOCUMENTS

| | | | |
|---|---|---|---|
| 768,283 | 8/1904 | Jenkins | 405/259 |
| 2,690,693 | 10/1954 | Campbell | 405/259 X |
| 2,950,602 | 8/1960 | Lang | 405/259 X |
| 3,250,170 | 5/1966 | Siegel | 405/259 X |
| 3,349,567 | 10/1967 | Munn | 405/259 |
| 4,098,087 | 7/1978 | Swain | 405/259 |

FOREIGN PATENT DOCUMENTS

| | | | |
|---|---|---|---|
| 0016742 | 10/1980 | European Pat. Off. | 405/259 |
| 2556493 | 6/1977 | Fed. Rep. of Germany | 405/259 |
| 0613118 | 6/1978 | U.S.S.R. | 405/259 |
| 0802554 | 2/1981 | U.S.S.R. | 405/259 |

*Primary Examiner*—Dennis L. Taylor

*Attorney, Agent, or Firm*—Frishauf, Holtz, Goodman & Woodward

[57] ABSTRACT

A rock bolt comprises an inflatable tube (11) which has a deep longitudinal depression (12). A wire coil (20) is mounted on the tube before the bolt is inserted in the borehole. When pressurized by high pressure water the tube (11) expands and clamps the coil (20) between itself and the borehole and the tube (11) is thereby permanently anchored in the borehole. The depression (12) develops during the expansion but the coil (20) prevents full expansion of the tube (11).

10 Claims, 9 Drawing Figures

METHOD OF ROCK BOLTING AND ROCK BOLT

BACKGROUND OF THE INVENTION

This invention relates to a method of rock bolting by inserting a rock bolt in a borehole which rock bolt comprises a radially expansible tube which, before being used, has a deep longitudinal depression and is closed at its inner end, and then coupling the outer end of the tube to an external source of hydraulic high pressure fluid so that the tube is plastically deformed to expand so as to cause permanent gripping action, whereafter, the tube is relieved of pressure.

The invention relates also to a rock bolt.

Such a method is described in European patent publication No. EP-A-0016742. The expansible rock bolts described in the mentioned publication have good rock reinforcing properties and their installation is very simple and fast. One size of bolt has a relatively large diameter range and the bolts have been manufactured in more than one size in order to cover almost all drilling equipment.

It is an object of the invention to extend the diameter range of an expansible rock bolt and to improve the anchoring. This is achieved by the definitions of the characterizing part of the claims.

BRIEF DESCRIPTION OF THE DRAWINGS

in FIG. 7.

DETAILED DESCRIPTION

Figure 1:
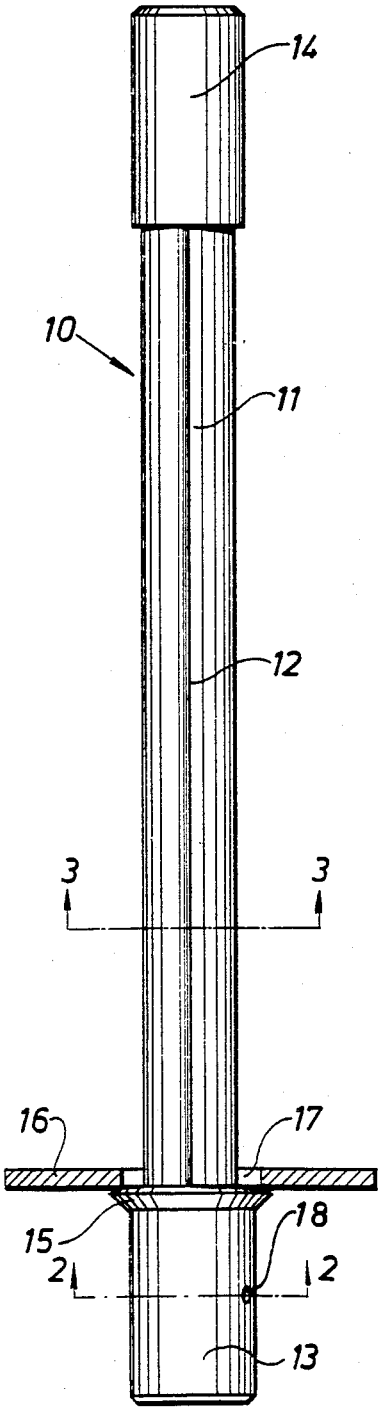
FIG. 1 is a longitudinal view of an expansible rock bolt.
Figure 2:
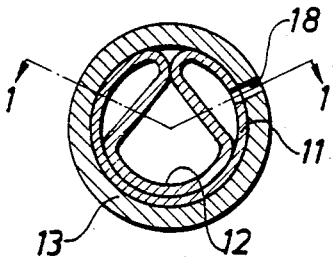
FIG. 2 is a transverse section taken along line 2—2 in FIG. 1 and on a larger scale.
Figure 3:
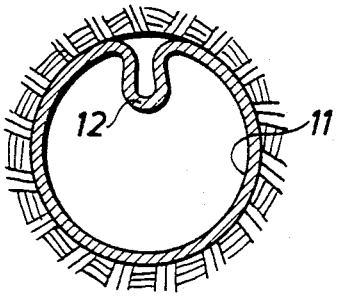
FIG. 3 is a section corresponding to FIG. 2 but taken along line 3—3 in FIG. 1 and showing the bolt expanded in a borehole.

The rock bolt 10 shown in FIGS. 1–3 comprises a tube 11 manufactured from a mild steel. The tube which originally had a circular periphery has been deformed and has a deep and inwardly widening depression 12 so that its outer diameter was reduced. The depression 12 is so deep that it is in contact with the opposite wall. The original diameter can for example be 41 mm and the diameter after deformation can be 28 mm. Two sleeves 13, 14 have been pressed onto the ends of the tube 11 and the ends have been sealed through welding which also fixes the sleeves 13, 14 to the tube 11. The outer one 13 of the sleeves has a flange 15 which is arranged to support a washer 16. The hole 17 of the washer 16 permits the washer to be put onto the bolt 11 from the inner end thereof passing over the inner sleeve 14 and the tube 11 to the flange 5. There is a radial hole 18 through the outer sleeve 13 and the wall of the tube

11, through which the interior of the tube can be pressurized by a high pressure fluid, usually water, so that the tube 11 expands by being plastically deformed. In FIG. 3, the bolt is shown expanded in a borehole which is wider than the bolt prior to expansion so that the bolt was freely inserted in the borehole but which is smaller than the diameter of the original tube. Therefore, the depression 12 could not completely expand in the borehole but it was reduced and left as an inwardly directed tongue 12. The tongue 12 was compressed by the water pressure and therefore, when the pressure is off, it acts as a spring and tends to widen so that it makes the bolt press against the walls of the borehole. The borehole may be more than 20% wider than the bolt prior to expansion of the bolt and still there will be a tongue 12 left after the expansion when the bolt has the illustrated form. The tube 11 may alternatively have more than one longitudinal depression 12, but a single depression gives the greatest diameter range.

Figure 4:
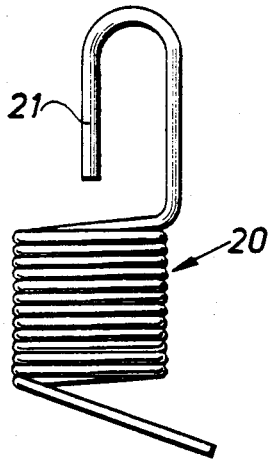
FIG. 4 is a longitudinal view of a coil which can be mounted on the bolt shown in FIGS. 1–3.
Figure 6:
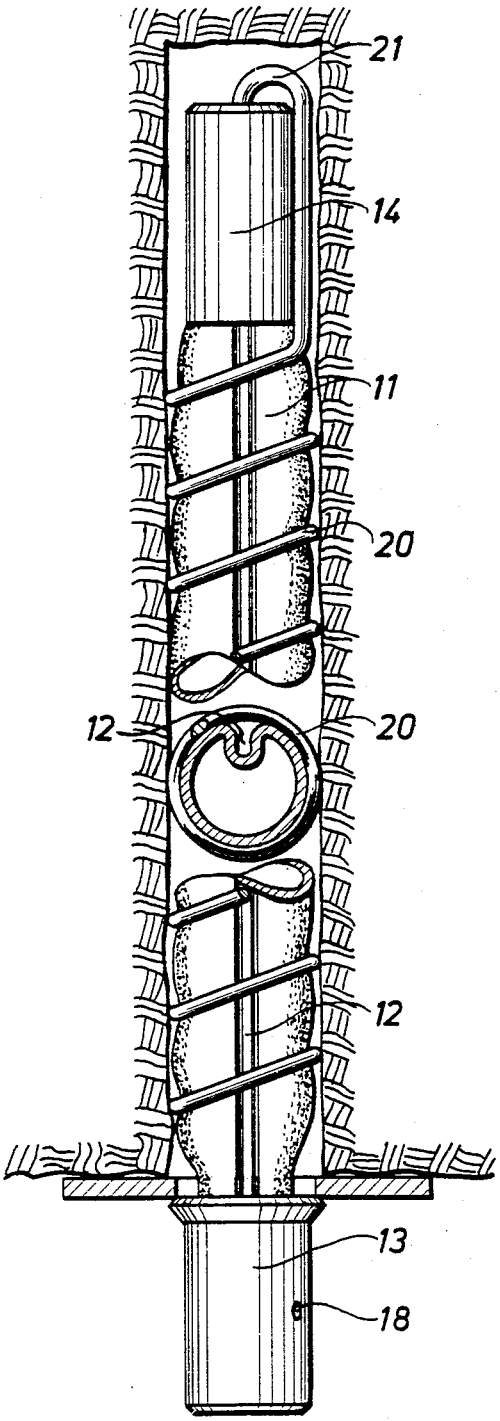
FIG. 6 is a longitudinal view corresponding to FIG. 5 but showing the bolt when expanded in the borehole so that it is anchored therein.
Figure 5:
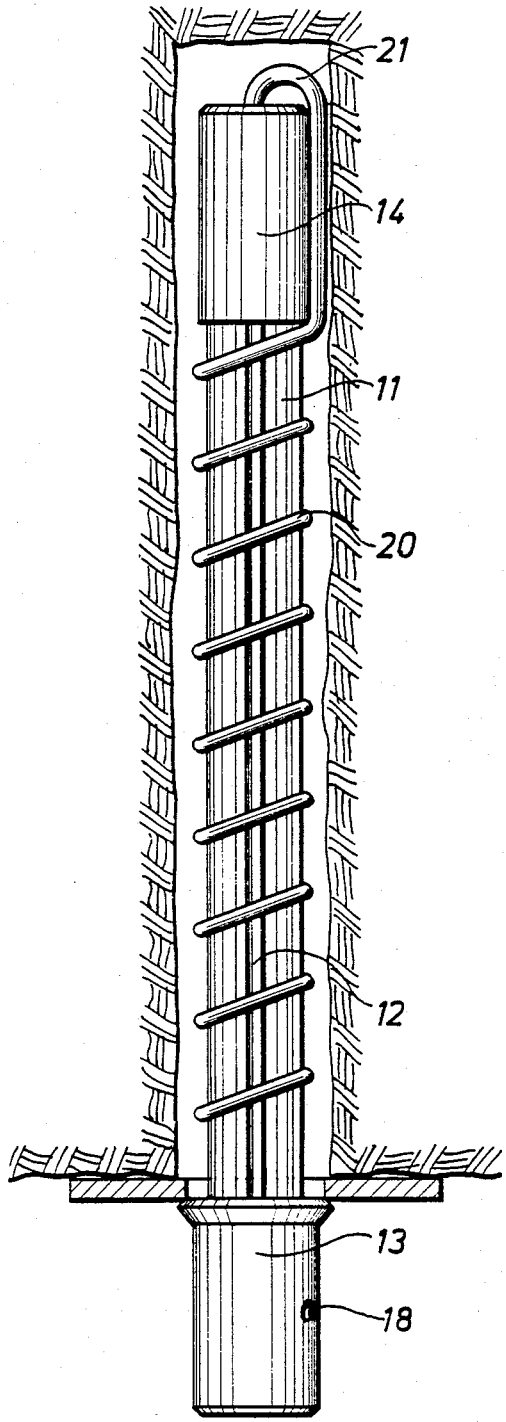
FIG. 5 is a longitudinal view of the bolt of FIGS. 1–3 on which the coil of FIG. 4 has been mounted and wherein the bolt with the coil is shown inserted in a borehole in the rock. A transverse section of the bolt is also shown in FIG. 5.
Figure 7:
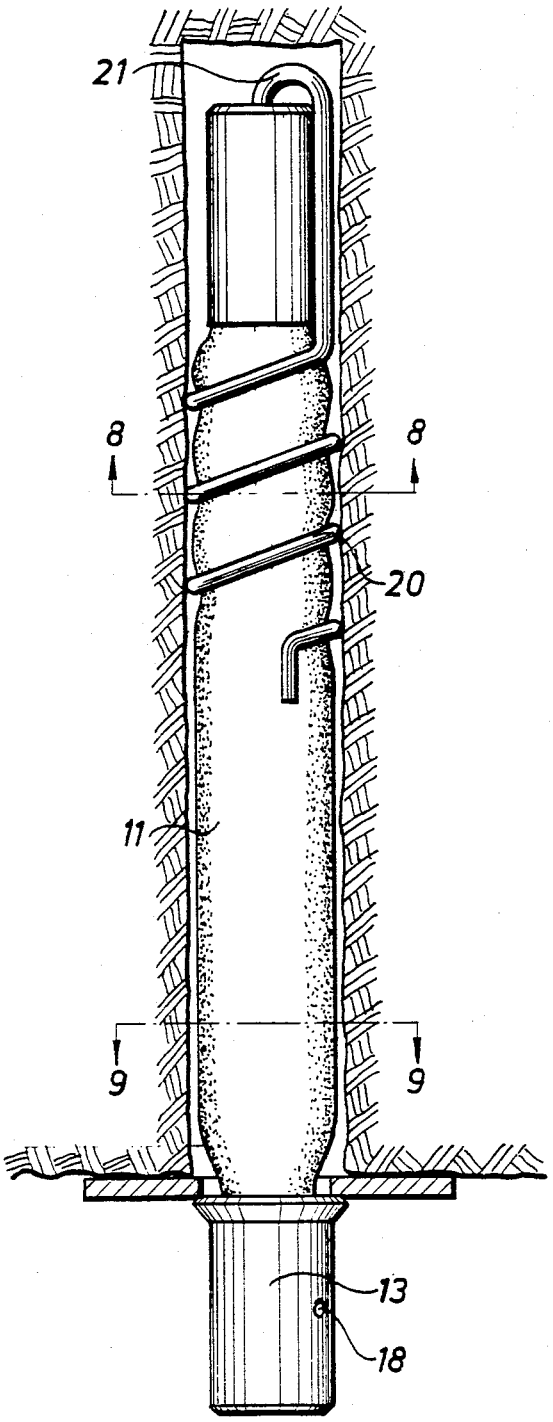
FIG. 7 is a longitudinal view of a rock bolt with a coil that is shorter than the coil shown in FIGS. 5 and 6.
Figure 8:
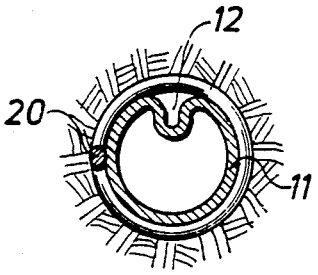
FIGS. 8 and 9 are transverse sections taken on lines 8—8 and 9—9 resp.
Figure 9:
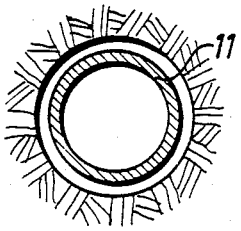

When the bolt 10 is to be installed in a borehole that has almost the same diameter as the original tube or is wider than the original tube, then a coil 20 shown in FIG. 4 manufactured of a wire of mild steel is first mounted on the end of the tube so that a hook 21 of the coil extends into the central hole in the bolt which is formed by the depression 12. The coil 20 may be wider than the borehole. Then, when the coil 20 is stretched, its diameter is reduced as can be seen in FIG. 5. When the tube 11 is pressurized through the hole 18, it expands and its force is great enough to expand the coil 20 so that the coil 20 is clamped between the tube 11 and the borehole. Thus, the tube 11 is firmly and permanently anchored in the borehole. The wire of the coil 20 may be extended without breaking, but it may also break into pieces when the bolt 10 is being expanded. The insert i.e., the coil 20, should have a small contact area against the rock as compared to the area of the tube 11 as illustrated in the Figures. The contact area of the insert against the borehole should be several times smaller than the area of the tube. In other words, the insert covers only a part of the tube surface that is adjacent the borehole. The tube 11 expands in the spacing between the turns of the wire as shown in FIGS. 6 and 7 so that the tube 11 becomes locked to the wire 20 and the contact pressure between the wire and the rock becomes higher than the fluid pressure by which the tube 11 is expanded. The coil 20 improves the anchoring at least in some rock, and it can be desirable to use a coil also when the tube 11 is wide enough to anchor without a coil.

As illustrated in FIG. 6, the tube 11 is anchored along its entire length. A shorter coil 20 can alternatively be used as can be seen in FIG. 7. Then the major part of the tube 11 is free to expand to its original diameter without being anchored in the borehole. Such top-anchored rock bolts are desirable in some kind of rocks. In practice, the maximum pressure for anchoring a bolt may be 250 bar whereas the tube may stand 400 bar before rupturing.

Instead of an insert between the tube and the borehole in the form of a coil 20, other kinds of inserts can be used. The inserts need not be separate units but they may be affixed to the tube. They can be glued or welded to the tube. The inserts can be directed axially along the tube but they should preferably be arranged substantially transverse to the bolt as the wire of the illustrated coil 20.

The installation device for the bolts is not illustrated. It consists of a chuck or holder with a fitting for the sleeve 13. The bolt is inserted in the borehole by means of the chuck. The chuck has a passage which is in communication with the hole 18 and coupled to a pump or booster which is activated to supply high pressure liquid, usually water, to the interior of the tube 11 when the bolt is home in the borehole in order to expand the tube 11. The tube 11 and the chuck is then relieved of pressure and the chuck is removed from the bolt 10 which is now permanently anchored in the borehole.

I claim:

1. A method of rock bolting comprising:

inserting a rock bolt (10) in a borehole which rock bolt comprises a radially expansible tube (11) which, before being used, has a deep longitudinal depression (12) and is closed at its inner end (14);

then coupling the outer end (13) of the tube (11) to an external source of hydraulic high pressure fluid so that the tube (11) is plastically deformed to expand so as to cause permanent gripping action against the inner surface of the borehole, whereafter the tube (11) is relieved of pressure; and before expanding of said tube (11) by said pressure fluid, mounting a radially expandable insert means (20) between the tube (11) and the borehole, said insert means (20) surrounding the tube so that said deep longitudinal depression (12) cannot be fully expanded in the borehole when the tube (11) is plastically deformed to radially expand upon application of said high pressure fluid, said insert means engaging both the tube and the inner surface of the borehole so as to be clamped therebetween.

2. A method according to claim 1, wherein said mounting step includes mounting said insert means (20) on the rock bolt (10) to be a part thereof before the rock bolt is inserted in the borehole.

3. A method according to claim 2, wherein said insert means comprises a coil (20) arranged around the tube.

4. A method according to claim 3, wherein said mounting step includes attaching said coil (20) to the inner end of the rock bolt (10), said coil (20) initially being wider than the borehole and substantially shorter than the tube (11); and axially expanding said coil (20) so that its diameter is reduced before or when the bolt is inserted in the borehole.

5. A method according to claim 1, wherein said insert means is located to cover only a part of the surface of the tube (11) that is adjacent the borehole wall.

6. A rock bolt comprising:

a radially expansible tube (11) which, before being used, has a deep longitudinal depression (12) and is closed at its ends but, at its outer end, has an inlet (18) through which it can be pressurized to permanently expand radially by being plastically deformed, said inlet being the only means for expanding of the tube (11); and radially expandable insert means (20) arranged outside of said tube (11) and surrounding said tube in order to engage with both the tube (11) and the inner surface of a borehole when the tube (11) is radially expanded in the borehole by means of pressure applied via said inlet (18) so as to anchor the bolt (10) in the borehole with said insert means (20) interposed and clamped between the tube and the inner surface of the borehole.

7. A rock bolt according to claim 6, wherein said insert means comprises a coil (20) arranged around the outside of the tube (11).

8. A rock bolt according to claim 7, wherein the coil (20) has an inner end (21) which is attached to an inner end of the bolt (10), and the major part of the coil is loosely arranged around the tube (11).

9. A rock bolt according to claim 6, wherein said insert means (20) has a contact area against the inner surface of the borehole which is small as compared to the tube area adjacent the inner surface of the borehole.

10. A method according to claim 1, wherein said insert means comprises a coil (20) arranged around the tube.

* * * * *